United States Patent [19]

Watermann et al.

[11] 4,041,715

[45] Aug. 16, 1977

[54] PIT PROP WITH LIFTABLE FRONT END

[75] Inventors: Willy Watermann, Dortmund-Berghofen; Walter von der Linden, Hoesel, both of Germany

[73] Assignee: Klockner-Werke AG, Duisburg, Germany

[21] Appl. No.: 719,144

[22] Filed: Aug. 31, 1976

[30] Foreign Application Priority Data

Sept. 9, 1975 Germany ..... 2540048

[51] Int. Cl.[2] ..... E21D 15/44

[52] U.S. Cl. ..... 61/45 D; 248/357

[58] Field of Search ..... 61/45 D; 299/32, 33, 299/31; 248/357; 91/170 MP

[56] References Cited

U.S. PATENT DOCUMENTS

| | | | |
|---|---|---|---|
| 3,276,819 | 10/1966 | Lobbe et al. | 299/32 |
| 3,649,078 | 3/1972 | Grebe et al. | 299/32 |
| 3,874,734 | 4/1975 | Plevak et al. | 61/45 D |
| 3,915,500 | 10/1975 | Schlusener et al. | 299/32 |

FOREIGN PATENT DOCUMENTS

| | | | |
|---|---|---|---|
| 2,330,764 | 9/1975 | Germany | 61/45 D |
| 1,384,543 | 2/1975 | United Kingdom | 299/43 |

*Primary Examiner*—Dennis L. Taylor
*Attorney, Agent, or Firm*—Michael J. Striker

[57] ABSTRACT

A pit prop has a floor-engaging foot, at least one arm pivoted at the rear of this foot and extending forwardly, a roof-engaging shield carried at the front end of this arm, and at least one ram extending vertically between the arm and the foot for pressing the shield against the roof and the foot against the floor. A hydraulic ram has its rear end pivoted at the rear end of the foot and its front end pivoted on the rear end of a rigid link whose front end in turn is pivoted on the face conveyor. The rear end of this link is slidable in and pivoted on the foot. A second link has its front end pivoted on the rear end of the main link and its rear end bearing vertically down against the foot but slidable therealong. A short lifting ram has its rear end pivoted on the rear end of the second link and its front end pivoted on the rear end of the main link above the pivot for the other displacement ram pivoted on this link. Thus expansion of this lifting ram raises the front end of the foot of the pit prop off the floor.

10 Claims, 5 Drawing Figures

PIT PROP WITH LIFTABLE FRONT END

BACKGROUND OF THE INVENTION

The present invention relates to a pit prop. More particularly this invention concerns such a pit prop useable in a mine at the face and connected to the face conveyor for supporting the mine roof immediately adjacent the face.

It is known to connect a plurality of pit props to a face conveyor. Each of these pit props comprises a foot that engages the floor and is shaped as a skid, an arm pivoted at the rear end of the skid and extending forwardly toward the face, a shield carried at the front end of the arm and engageable with the mine roof, and a hydraulic ram between the foot and the arm for pressing the shield against the roof. Such an assembly serves to prevent cave-ins at the face.

Typically each of these pit props is connected via a hydraulic ram to the face conveyor for displacement of the pit prop and of the face conveyor by means of these rams. Thus when all of the pit props are locked between the mine floor and ceiling it is possible by actuation of the rams to displace the face conveyor toward or away from the face. Similarly, when all but one of the pit props are locked between the mine roof and ceiling, it is possible to relax the main ram of one of the props and use its displacement ram connected to the face conveyor to displace this prop relative to the conveyor. In this manner it is possible to move these pit props and the face conveyor along as the seam is worked.

A considerable disadvantage of such systems is that the foot of the pit prop is often pressed into the ground by the considerable force exerted by its main ram pressing the shield against the roof. In order subsequently to displace the pit prop it is necessary either somehow to lift the front end at least of the foot out of the hole formed by it, or to pull it with such a force that it can simply push aside the material in which it has embedded itself.

It has been suggested to provide both at the front and rear ends of the floor-engaging foot or skid of the pit prop a vertical ram connected at its upper end to the foot and at its lower end carrying a floor-engageable skid. Thus if either of these ends sinks into the floor it is possible to operate this vertical ram and lift up the sinking end. Such an arrangement has the difficulty that the frequently soft floor does not provide a sufficiently sound purchase so the extra lifting skid merely will sink in also. Furthermore, such extra mechanism requires considerable redesigning of the pit prop, as the space for such a mechanism, at least at the front end of the prop, is normally occupied by other structure.

OBJECTS OF THE INVENTION

It is therefore an object of the present invention to provide an improved pit prop useable at the working face of a mine.

Another object is the provision of such a pit prop which overcomes the above-given disadvantages.

A further object is the provision in a pit prop or face support of a simple arrangement that allows the front end of the foot of the pit prop to be lifted out of a hole or over an object.

These objects are attained according to the present invention in a pit prop of the above-described general type wherein the stepping or displacement ram that extends parallel to the floor has its rear end connected to the foot of the pit prop and its front end pivoted on a link which itself has a rear end pivoted on and slidable relative to the foot of the pit prop and a front end pivoted on the support and normally constituted by the face conveyor. A lifting ram separate from the main ram that presses the shield against the roof and a displacement ram that displaces the pit prop is provided which extends between the rear end of the link and the foot. This ram is extensible to lift the front end of the foot of the pit prop off the floor.

According to another feature of this invention the lifting ram has itself a front end pivoted on the rear end of the link above the pivot for the displacement ram, and has a rear end which it engages vertically downwardly against the foot of the pit prop. To this end a second link separate from the main link is provided which is pivoted at its front end at the pivot for the front end of the displacement ram and is pivoted at its rear end on the rear end of the lifting ram. The rear end of this second link bears vertically downwardly against the top of the foot of the pit prop so that extension of the lifting ram whose front end is pivoted on the main link directly above the pivot for the displacement ram forces the rear end of the second link downwardly and, therefore, lifts the front end of the foot.

According to further features of this invention the main link is provided at its rear end with a pair of laterally projecting pins defining a pivot axis and underlying a pair of parallel horizontal flanges on the foot. The rear end of the secondary link lies on top of these flanges.

In accordance with yet another feature of the present invention the main link is formed by a pair of parallel rigidly interconnected plates or beams which extend from their front end where they are pivoted on the support constituted by the face conveyor to their rear ends where they are provided with the above-mentioned pins that allow pivoting of this main link relative to the foot. This foot is formed with an upwardly open channel whose flanks are provided with the above-mentioned flanges on which the secondary link bears and under which the pivot pins for the rear end of the main link are engaged. The main link is slidable in this channel between these flanges.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

SPECIFIC DESCRIPTION OF A PREFERRED EMBODIMENT

Figure 1:
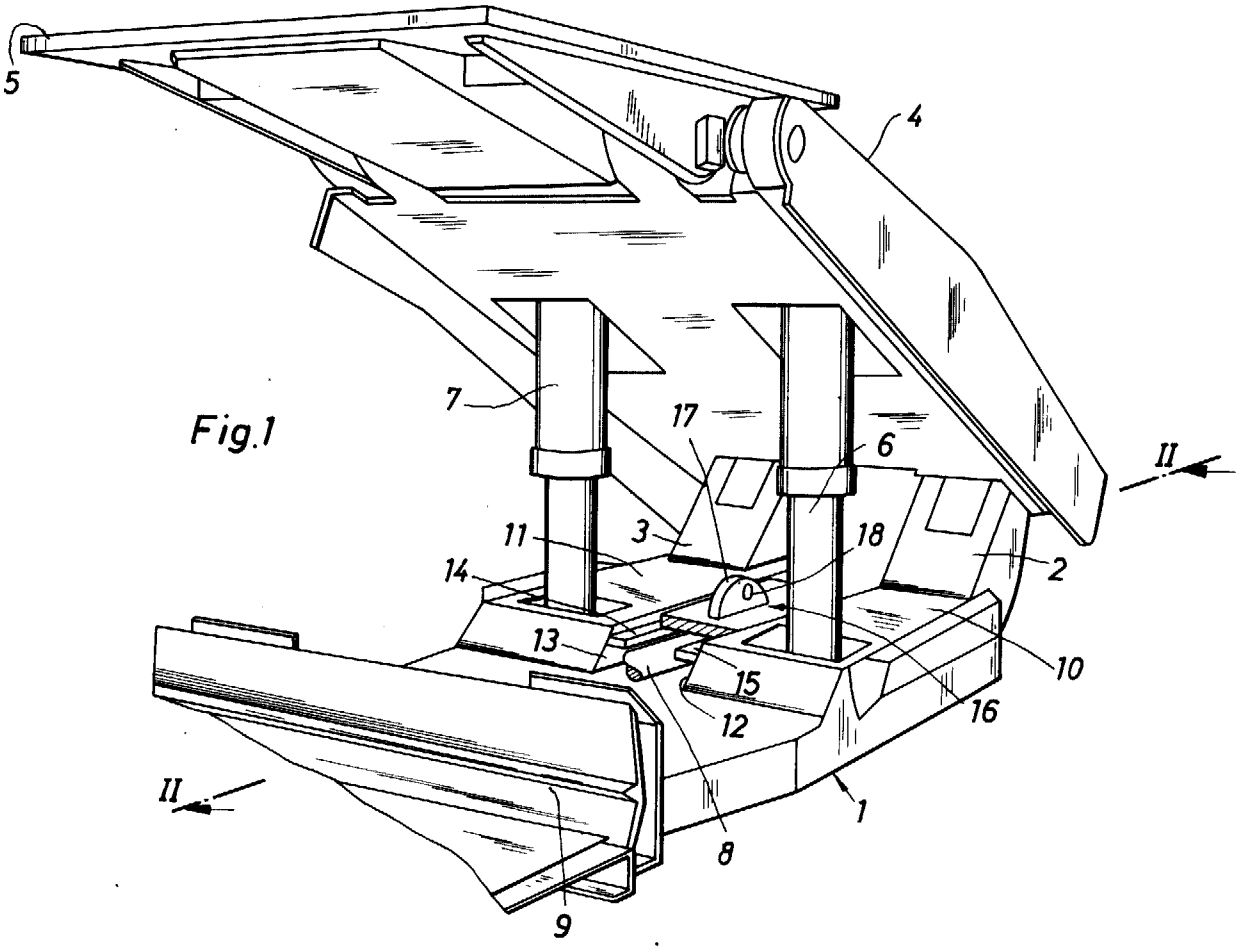
FIG. 1 is a perspective view with parts broken away of the pit prop according to this invention connected to a face conveyor.

As shown in FIG. 1 a pit prop has a foot or base plate 1 on whose rear end is provided a pair of mounts 2 and 3 defining a horizontal pivot axis for an arm 4 carrying at its front end a roof-engaging shield 5. A pair of rams 6 and 7 serve to press the shield 5 against the roof and force the base plate 1 against the floor. A horizontal displacement ram 8 has its rear end pivoted on the foot or base plate and its front end pivoted via a link 20 which will be described below on a face conveyor 9. Raised portions 10 and 11 at the rear end of the foot 1 have inner flanks 12 and 13 which define an upwardly open channel in which the cylinder 8 is provided.

Figure 2:
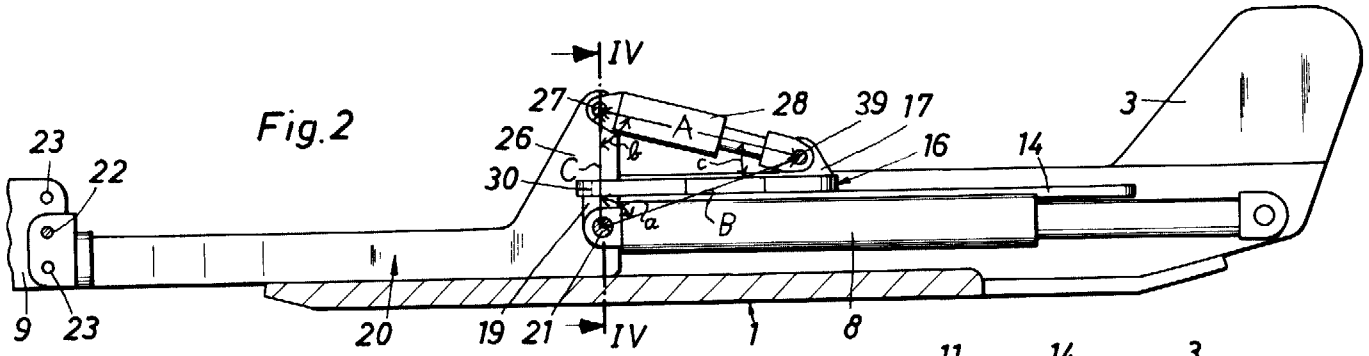
FIG. 2 is a section taken along line II—II of FIG. 1.
Figure 3:
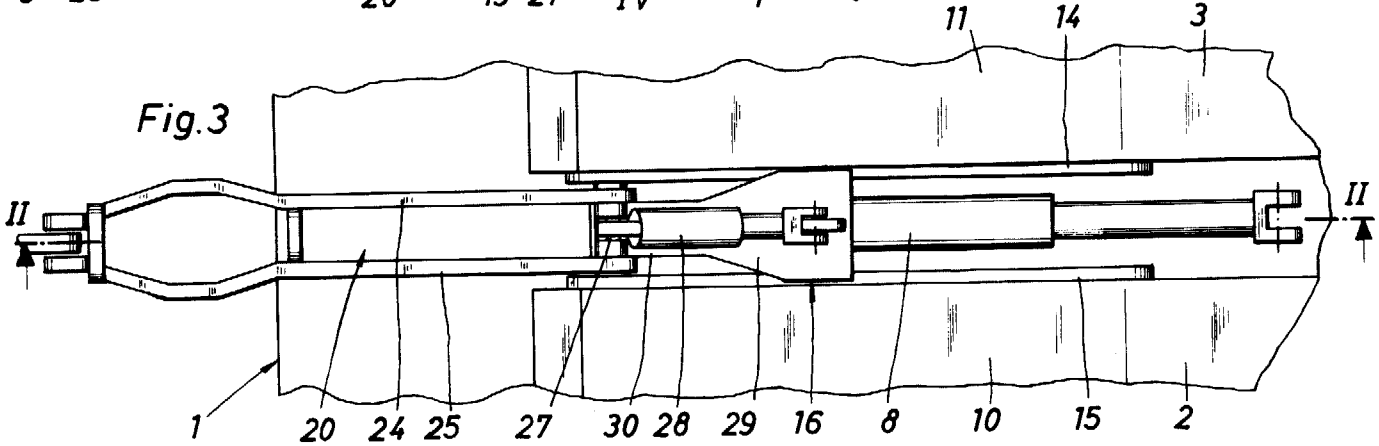
FIG. 3 is a top view of the detail shown in FIG. 2, line II—II of FIG. 3 indicating the section line for FIG. 2.
Figure 4:
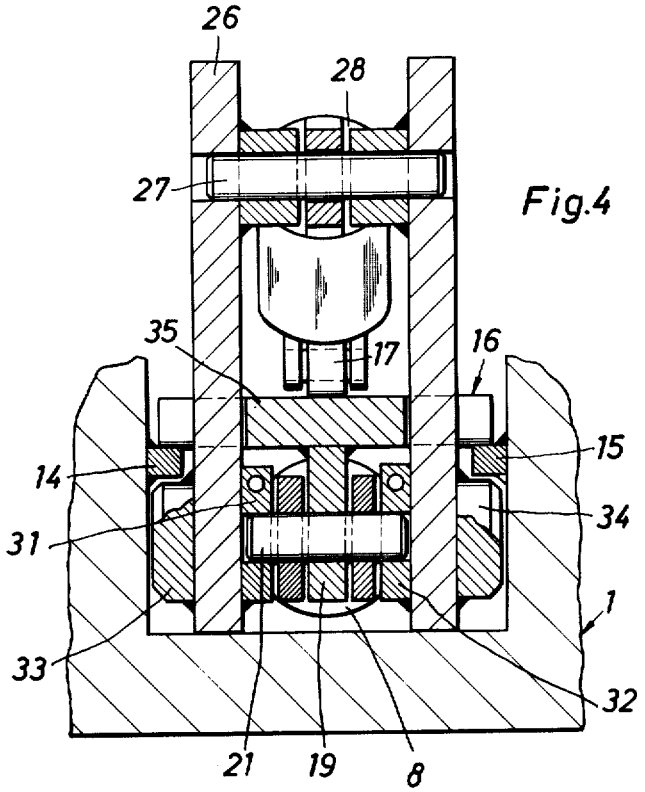
FIG. 4 is a vertical section in enlarged scale taken along line IV—IV of FIG. 2.

As also shown in FIGS. 2, 3 and 4, the surfaces 12 and 13 are provided with parallel horizontally extending and inwardly projecting flanges 14 and 15 on which a secondary link 16 may bear. This link 16 has at its rear end an upwardly extending flange or lug 17 formed with a throughgoing hole 18 and at its front end with a downwardly extending flange 19 through which engages a pin 21 fixed in the two plates 24 and 25 forming the link 20. This link 20 is connected at its front end via a pin 22 extending through holes 23 to the face conveyor 9. It is noted that a plurality of such holes 23 are provided for pivoting of the link 20 about a horizontal axis defined by the pin 22 on the conveyor 9 which is normally fixed.

At its rear end the link 20 is formed with a pair of upwardly extending lugs 26 between which extends a horizontal pin 27 directly above the pin 21. A lifting ram 28 has its front end pivoted on the pin 27 and its rear end pivoted on a pin 29 passing through the hole 18.

As best shown in FIG. 3 the plate forming the link 16 has a rear section 29 of a width greater than the spacing between the flanges 14 and 15 so that it rides on these flanges 14 and 15 and a front end 30 which is substantially narrower so that it can pass between the plates 24 and 25 forming the main link 20.

Between the plates 24 and 25 there are a pair of tightenable bearings 31 and 32 for the ends of the pin 21. In addition directly in line with this pin 21 are laterally projecting short stub pins 33 and 34 which respectively engage under the flanges 14 and 15 and, therefore, allow the link 20 to slide in the channel formed between the surfaces 12 and 13 (FIG. 1) while being vertically swingable about the axis defined by these pins 33 and 34 as well as by the pin 21. As mentioned above the extreme front end 35 of the secondary link 16 is received between the plates 24 and 25.

It is clear from FIG. 2 that extension of contraction of the main stepping or displacement ram 8 will cause the foot 1 to slide relative to the link 20 and the face conveyor 9. Such an expansion or contraction allows the entire pit prop to be moved along the floor of the mine when the face conveyor 9 is fixed, or allows the face conveyor 9 to be displaced relative to the pit prop.

As shown in FIG. 2 the pins 27, 29, and 21 form a triangle having a side A between pins 27 and 29, a side B between pins 29 and 21, and a side C between pins 21 and 27. The sides B and C form an angle *a,* the sides A and C form an angle *b,* and the sides A and B form an angle *c.* Should the rear end of the pit prop lift relative to its front end it is therefore apparent that, so long as the cylinder 28 is not pressurized, the angle *a* will decrease as will the length of the side A. Similarly, it is clear from this illustration that if the cylinder 28 is pressurized the length of side A will increase, thereby simultaneously increasing the angle *a,* increasing angle *b,* and decreasing angle *c.* The length of sides B and C are fixed.

Figure 5:
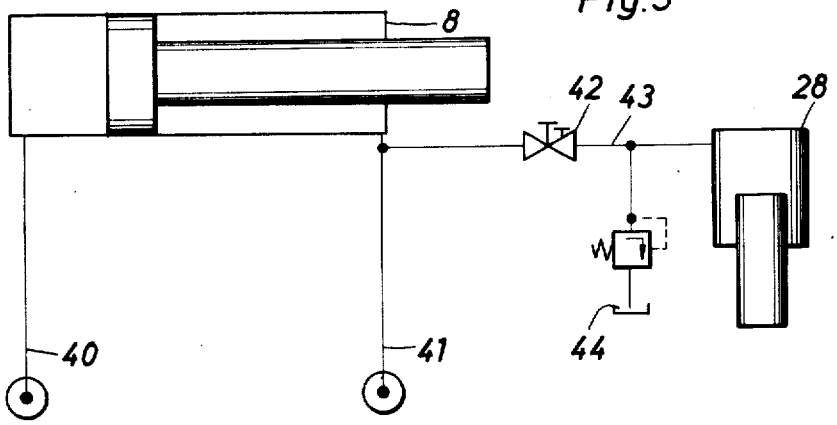
FIG. 5 is a largely schematic diagram illustrating operation of the arrangement according to this invention.

Thus as illustrated with reference to FIG. 5 it is possible to pressurize the cylinder 8 either from a source of pressure 40 or source of pressure 41. Source of pressure 41 is connected through a valve 42 to a line 43 that pressurizes the single-acting ram 28. A pressure-regulating valve and reservoir 44 are provided to limit the pressure that can build up in line 43. Thus when the chamber between the piston rod and the cylinder of rod 8 is pressurized so as to shorten this ram 8 and, therefore, pull the foot 1 toward the support 9, the cylinder 28 will be simultaneously pressurized in order to maximize the length of side A of the above-described triangle and, therefore, lift the front end of the foot 1 out of any recess in which it might be. The particular formation of the arrangement ensures that with maximum pressurization of ram 28 the link 20 and the base of the groove defined between the sides 12 and 13 will be directly aligned to each other.

Therefore with the system according to the present invention it is possible with relatively simple and completely automatically functioning means to lift the front end of the foot 1 of a pit prop out of a recess in which the pit prop might find itself and similarly to prevent this front end from digging into the ground as it is pulled along. This system also makes it possible to attach the ram 8 relatively far back toward the rear of the pit prop in order to maximize the length of this ram 8 and, therefore, make the stepping of this pit prop along the ground relatively easy.

It will be understood that each of the elements described above, or two or more together, may also find a useful application in other types of structure differing from the types described above.

While the invention has been illustrated and described as embodied in a pit prop, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pit prop comprising:

a floor-engaging foot slidable toward and away from a relatively fixed support in a predetermined direction;

a main link having a front end pivoted on said support and a rear end pivoted on said foot and slidable therealong generally parallel to said direction;

a displacement ram extending between said main link and said foot and expansible and contractile in said direction, whereby expansion and contraction of said displacement ram moves said foot relative to said support in said direction;

a secondary link having a front end pivoted on said rear end of said main link and having a rear end bearing downwardly on and slidable along said foot; and a lifting ram pivoted on said rear end of said main link above said secondary link and pivoted on said rear end of said secondary link, whereby expansion of said lifting ram urges said rear end of said main link upwardly.

2. The pit prop defined in claim 1, further comprising a forwardly extending arm pivoted on the rear end of said foot, a roof-engaging shield carried on the front end of said arm, and a hydraulic cylinder between said arm and said foot for pressing said arm against the roof and said foot against the floor.

3. The prop defined in claim 1 wherein said front and rear ends of said main link are pivoted on said support and on said foot about generally parallel respective front and rear link axes, said lifting ram being pivoted on said rear end of said main link and said rear end of said secondary link about generally parallel respective front and rear ram axes generally parallel to said link axes, said front ram axis lying above said rear link axis.

4. A pit prop comprising:

a floor-engaging foot slidable toward and away from a relatively fixed support in a predetermined direction;

a main link having a front end pivoted on said support about a front link axis and a rear end pivoted on said foot about a rear link axis parallel to said front link axis and slidable along said foot substantially perpendicularly to said axes;

a displacement ram extending between said rear end of said main link and said foot and expansible and contractile for displacement of said foot relative to said support in said direction;

means including a secondary link pivoted on said rear end of said main link and bearing vertically downwardly on said foot and a lifting ram operatively engaged between said main link and said foot for lifting the front end of said foot, said lifting ram being pivoted on said rear end of said main link about a front ram axis above and generally parallel to said rear link axis and being pivoted on the rear end of said secondary link, whereby expansion of said lifting ram forces said rear end of said secondary link downwardly relative to said rear link axis;

a forwardly extending arm pivoted on the rear end of said foot;

a roof-engaging shield carried on the front end of said arm; and a hydraulic cylinder between said arm and said foot for pressing said shield against the roof and said foot against the floor.

5. The pit prop defined in claim 4 wherein said foot is formed with a pair of parallel flanks extending substantially perpendicularly to said axes and each provided with a respective flange extending toward and parallel to each other, said main link being provided with outwardly directed stub pins defining said rear link axis and engaged under said flanges.

6. The pit prop defined in claim 5 wherein said flanks define an upwardly open channel in which said rear end of said main link is slidable.

7. The pit prop defined in claim 6 wherein said flanges are spaced apart by a predetermined distance in a transverse direction and said main link and the front end of said secondary link are narrower in said transverse direction than said predetermined distance, whereby said main link and said front end of said secondary link can pass between said flanges.

8. The pit prop defined in claim 7 wherein said support is a face conveyor.

9. The pit prop defined in claim 8 wherein said displacement ram has a chamber pressurizable to displace said foot toward said support and said lifting ram has a chamber pressurizable to press the rear end of said secondary link down on said foot, said pit prop further comprising means for simultaneously pressurizing both of said chambers.

10. The pit prop defined in claim 7 wherein said displacement ram is pivoted on said foot adjacent the rear end thereof.

* * * * *